US007832377B2

(12) United States Patent
Lee et al.

(10) Patent No.: US 7,832,377 B2
(45) Date of Patent: Nov. 16, 2010

(54) THERMAL PROTECTION FOR FUEL INJECTORS

(75) Inventors: Fei Philip Lee, Holland, MI (US); Paul G. Hicks, Holland, MI (US)

(73) Assignee: Woodward Governor Company, Fort Collins, CO (US)

( * ) Notice: Subject to any disclaimer, the term of this patent is extended or adjusted under 35 U.S.C. 154(b) by 169 days.

(21) Appl. No.: 12/233,671

(22) Filed: Sep. 19, 2008

(65) Prior Publication Data

US 2010/0071666 A1 Mar. 25, 2010

(51) Int. Cl.
*F02M 61/14* (2006.01)
*F02M 61/18* (2006.01)

(52) U.S. Cl. ..... 123/470; 60/740

(58) Field of Classification Search ..... 123/470, 123/467, 468, 469, 540; 60/740, 733, 736, 60/746, 800; 239/132
See application file for complete search history.

(56) References Cited

U.S. PATENT DOCUMENTS

| | | | | |
|---|---|---|---|---|
| 4,409,791 | A * | 10/1983 | Jourdain et al. | 60/240 |
| 4,938,418 | A | 7/1990 | Halvorsen | |
| 5,423,178 | A | 6/1995 | Mains | |
| 5,598,696 | A * | 2/1997 | Stotts | 60/779 |
| 6,149,075 | A | 11/2000 | Moertle et al. | |
| 6,547,163 | B1 * | 4/2003 | Mansour et al. | 239/404 |
| 6,755,024 | B1 | 6/2004 | Mao et al. | |
| 6,877,306 | B2 | 4/2005 | Wernberg et al. | |
| 2004/0129001 | A1 * | 7/2004 | Lehtinen | 60/740 |
| 2007/0193272 | A1 | 8/2007 | Hebert et al. | |
| 2007/0283931 | A1 | 12/2007 | Mao | |
| 2009/0126687 | A1 | 5/2009 | Paterson | |

FOREIGN PATENT DOCUMENTS

| | | |
|---|---|---|
| DE | 41 27 455 A1 | 2/1993 |
| EP | 1 793 169 A2 | 6/2007 |
| JP | 8049513 A | 2/1996 |

OTHER PUBLICATIONS

U.S. Appl. No. 12/194,597, filed Aug. 20, 2008, Smith.
U.S. Appl. No. 12/233,697, filed Sep. 19, 2008, Hicks et al.
U.S. Appl. No. 12/199,376, filed Aug. 27, 2008, Hicks.
U.S. Appl. No. 12/569,996, filed Sep. 30, 2009, Smith.

* cited by examiner

*Primary Examiner*—Mahmoud Gimie
(74) *Attorney, Agent, or Firm*—Reinhart Boerner Van Deuren P.C.

(57) ABSTRACT

A fuel injector is provided. The fuel injector includes an injector support and a heat shield coupled to the injector support. The heat shield only interacts with the injector support by way of contacts such as point contacts, line contacts or surface contacts. Further, the heat shield includes a body portion, a radially extending flared end portion and a radially directed shoulder interposed between the body portion and the flared end portion. The shoulder portion acts as a flexure point that flexes and absorbs thermal expansion of the heat shield.

18 Claims, 2 Drawing Sheets

THERMAL PROTECTION FOR FUEL INJECTORS

FIELD OF THE INVENTION

This invention generally relates to fuel delivery systems and more particularly to fuel injectors (i.e. fuel nozzles) for delivering fuel to combustors for turbine engines.

BACKGROUND OF THE INVENTION

Fuel injectors (nozzles) are important components of gas turbines as well as other gas combustion engines. Because the fuel injector is the source of the fuel, the fuel injector can provide significant play in the role of engine performance.

Because the fuel injector extends into the engine case and particularly between the compressor and the combustion chamber in a gas turbine, typically, a fuel injector includes an external support/stem through which an internal fuel tube extends to support and protect the fuel tube. The fuel tube will be connected to an atomizer or other tip to improve the delivery state of the fuel into the combustion chamber so that it will more fully mix with air in the combustion chamber.

During operation, the support/stem is surrounded by high-temperature and high-pressure compressor air within the compressor discharger cavity where the air exits the compressor. However, it is desirable to deliver the fuel at a much lower temperature than the compressor air and therefore to prevent heat transfer from the compressor air to the support system and ultimately the fuel. Particularly, because if too much heat is transferred to the fuel, the fuel can begin to coke, thereby ruining or reducing the quality of the fuel. Additionally, coke depositions may occur that further inhibit the efficiency of the fuel injector. There have, therefore, been attempts to reduce the amount of heat that can be transferred from the high-temperature compressor air to fuel passing through the fuel injector.

Unfortunately, the support/stem is typically a solid cast piece that can allow for significant heat transfer. Attempts to reduce heat transfer to the fuel have included surrounding the stem/support with a heat shield. Unfortunately, past attempts to include a heat shield have directly connected the heat shield to the support/stem by soldering or brazing. For example, this type of connection can be seen in U.S. Pat. No. 6,149,075 issued Nov. 21, 2000 to Moertle et al where a butt weld serves an end of the heat shield to an overhang flange of the support system.

A first problem with this arrangement is the attachment locations create a heat transfer path providing heat flux short circuiting from the air flow to the injector, defeating the thermal protection provided by the heat shield. This is amplified by the fact that the attachment locations or connection between the heat shield and support/stem is typically positioned within the combustion chamber further promoting heat transfer between the heat shield and the support/stem.

Additionally, as this junction promotes localized heat transfer at the point of the junction, thermal gradients are also created at the site of the junction creating thermal stresses. These thermal stresses are further compounded by the fact that these junctions are typically butt or lap type weld joints which are inherently less reliable.

Finally, as the heat shield is typically connected at or proximate to opposite ends of the support/stem, the thermal growth differential between the heat shield and the underlying cooler support/stem creates additional stress fights within the fuel injector, and particularly the heat shield and the support/stem The present invention relates to improvements over the current state of the art in fuel injectors.

BRIEF SUMMARY OF THE INVENTION

In view of the above, embodiments of the present invention provide new and improved fuel injectors (also referred to as fuel nozzles) for combustion engines. More particularly, embodiments of the present invention provide new and improved fuel injectors for combustion engines that reduce heat transfer from a heat shield to an injector support. Other embodiments of the present invention provide new and improved fuel injectors for combustion engines that reduce the number or quality of the heat paths between the heat shield and the injector support. Other embodiments of the present invention provide new and improved fuel injectors for combustion engines that reduce the internal stresses due to thermal expansion of the heat shield and injector support.

In one embodiment, a fuel injector comprising an injector support and a heat shield is provided. The injector support includes a mounting portion, a stem portion and a mounting flange interposed between the mounting portion and the stem portion. The mounting flange extends radially outward from the head and stem portions. The injector support further includes a bore extending through the mounting portion and stem portion from an upstream end to a downstream end. The heat shield surrounds at least the stem portion of the injector support. The heat shield is operably coupled to the injector support to reduce heat transfer therebetween.

In one particular implementation of the embodiment, the heat shield is operably coupled to the injector support such that the heat shield interacts with the injector support solely through one or more contacts and is free of welds or brazes that would otherwise promote heat transfer between the heat shield and injector support. In a further particular embodiment, the heat shield is secured axially between a protrusion of the injector support at an opposite (downstream) end of the support and the mounting flange.

In another embodiment, an improved combustion assembly for combusting fuel is provided. The combustion assembly includes an engine case defining a cavity and a fuel injector mounted to the engine case. The fuel injector includes a support structure and a heat shield. The support structure includes a mounting portion, a body portion and a mounting flange extending radially outward from the mounting portion. The heat shield includes a heat shield body portion and a flared flange. The flared flange extends radially outward beyond the heat shield body portion. The fuel injector extends into the cavity through an aperture in the engine case with the mounting portion positioned outside of the cavity and the body portion positioned within the cavity. The aperture is sized smaller than the mounting flange and the flared flange such that the mounting flange and flared flange overlap a portion of the engine case. The overlapping portion of the flared flange is sandwiched between the engine case and the mounting flange.

In yet another embodiment, an improved fuel injector is provided including an injector support and a heat shield. The injector support includes a stem portion and a mounting flange extending radially outward from the stem portion. The injector support further includes a bore extending through stem portion between an upstream end and a downstream end. The heat shield includes a body portion, a flared end extending radially outward from the body portion and a shoulder transitioning between the body portion and the flared end. The body portion surrounds the stem portion of the injector support. The flared end is generally aligned with the mounting flange of the injector support. The shoulder and the mounting flange form a gap therebetween. The shoulder provides a flexure point for accommodating thermal expansion and contraction of the heat shield and/or the injector support by transitioning between a concave state and a convex state.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
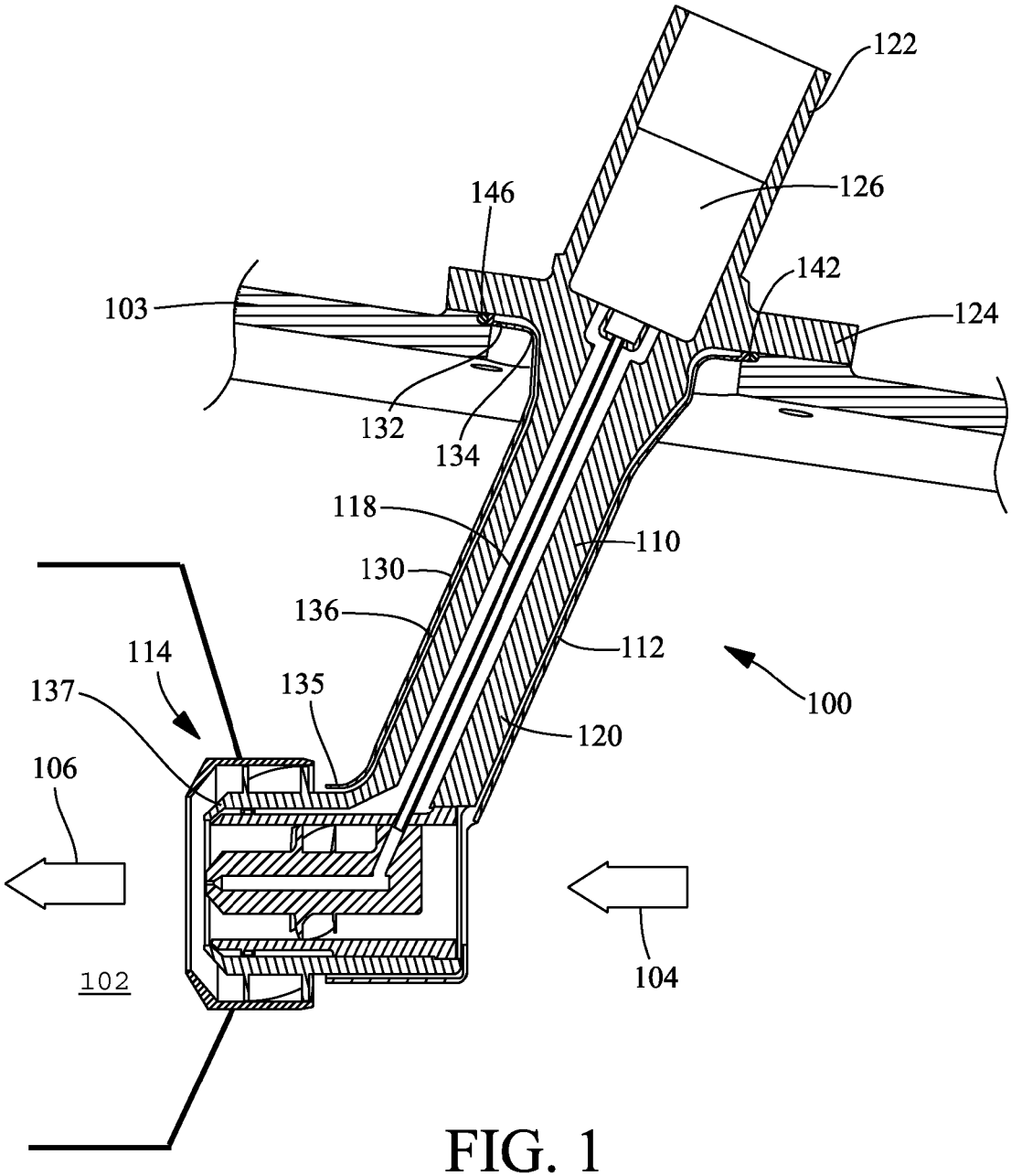
FIG. 1 is an simplified schematic illustration of a combustion arrangement including a fuel injector mounted to an engine case in accordance with the teachings of the present invention.
Figure 2:
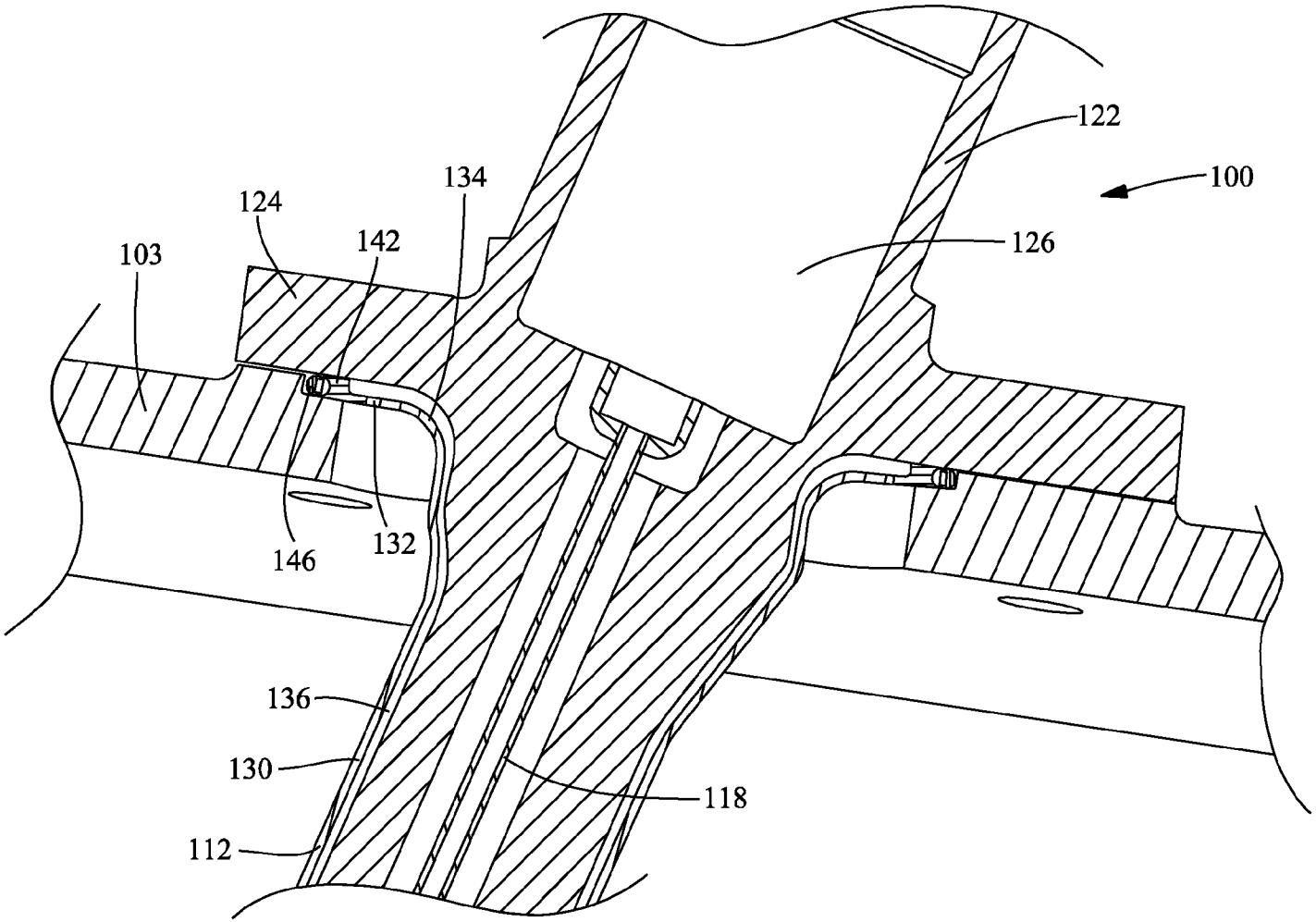
FIG. 2 is an enlarged cross-sectional illustration of the fuel injector of FIG. 1 according to the teachings of the present invention.

Turning now to FIG. 1, a fuel injector 100 (which may also be referred to as a fuel nozzle) is illustrated in a suitable environment for delivery of fuel to a combustor or combustion chamber 102 defined by a boundary wall in the form of engine case 103. Preferably, the combustion chamber 102, illustrated in simplified form, is the combustion chamber of a gas turbine. However, the fuel injector 100 could be implemented in other systems requiring combustion of a fuel such as an internal combustion piston engine. Further, the combustion chamber 102 is typically downstream from a compressor (not illustrated).

Fuel supplied from the injector 100 is combusted in the combustion chamber 102 with high-temperature and high-pressure compressor air, illustrated as arrow 104 from an upstream compressor (not shown). As is well known in the art, the combusted gasses, illustrated as arrow 106, when in a turbine environment, flow out of the combustion chamber and drive a set of turbine blades (not shown). During this process, because the fuel injector 100 extends into the engine case 103 and is between the compressor and the combustion chamber, the fuel injector 100 is exposed to extreme temperatures and forces due to the high-temperature, high-pressure air being discharged from the compressor, (within an area referred to as a compressor discharger area).

The injector 100 includes a support structure illustrated as an injector support 110 (also referred to as an injector support 110), a heat shield 112, an injector atomizer 114 (i.e. tip) and a fuel tube arrangement illustrated as single fuel tube 118. However, other numbers of fuel tubes may be used. For instance, the fuel tube arrangement can include a plurality of concentric or parallel fuel tubes.

The injector support 110 is a form of a support structure or injector body that extends into the engine case 103 to provide support for and protection of the fuel tube 118. The injector support 110 includes a stem body portion 120, a mounting portion 122 and a stem mounting flange 124. As illustrated, the stem body portion 120, mounting portion 122 and stem mounting flange 124 are formed as a one-piece construction as a rigid body that is typically formed from cast metal. However, alternative support structures may be used in practicing the teachings of the present invention, such as a combination of a plurality of separate components that are connected together. The stem mounting flange 124 separates the mounting portion 122 from the stem body portion 120 and extends radially outward therefrom. The mounting portion 122 and stem mounting flange 124 are positioned external to the engine case 103.

The injector support 110 defines a central bore 126 that passes through the stem body portion 120, mounting portion 122 and stem mounting flange 124. The central bore 126 provides a cavity through which the fuel can flow from an upstream end to a downstream end toward injector atomizer 114. In the illustrated embodiment, the central bore 126 houses fuel tube 118.

The heat shield 112 provides a thermal barrier or insulator that inhibits heat transfer from the compressor air 104 to injector support 110 and ultimately to the fuel passing through fuel tube 118. The heat shield 112 surrounds the stem body portion 120 of the injector support 110.

The heat shield 112 generally includes a heat shield body portion 130 and a flared end portion 132 that are separated from one another by an annular transition shoulder 134. The heat shield body portion 130, flared end portion 132 and annular transition shoulder 134 are typically formed form a single piece of material in a one-piece construction. As such, the shoulder 134 forms a continuous transition between the heat shield body portion 130 and flared end portion 132

The heat shield body portion 130 extends between first and second opposed ends. The first end is proximate shoulder 134 while the second end is proximate injector atomizer 114. The heat shield 112 is sized relative to the injector support 110 such that little clearance is provided between the second end 135 and a tip end 137 of the injector support 110 or alternatively the injector atomizer 114. In a preferred implementation, the heat shield is secured to the injector support 110 strictly by the configuration of the heat shield relative to the injector support 110 and free of any additional structure such as welds or brazes. More particularly, in the illustrated embodiment, the heat shield is positioned axially between the tip end 137 and mounting flange 124 of the injector support 110.

The second end 135 of the heat shield 112 preferably includes dimples (not shown) that rest against the tip end 137 or injector atomizer 114. By providing dimples, only a point contact is provided between the heat shield and the injector support 110 or injector atomizer 114 thereby reducing any heat transfer path between the heat shield and the injector support 110 or injector atomizer 114. The mounting flange 124 and tip end 135 or injector atomizer 114 act as protrusions or projections between which the heat shield as axially affixed relative to the injector support 110.

The stem mounting flange 124 and the flared end portion 132 of the heat shield 112 generally align with one another and are substantially parallel to one another. Further, the flared end portion 132 and mounting flange 124 preferably extend at an angle of between about 50 degrees and 90 degrees relative to an axis defined by the stem body portion 120 extending from the upstream end of the downstream end.

In a preferred embodiment, the heat shield 112 is not integrally connected to the injector support 110. Further, in a preferred embodiment, the heat shield flared end portion 132 is connected to or formed into an annular contact ring 142.

The contact ring 142 may be welded, brazed or otherwise connected to the heat shield flared end portion 132 or formed into or proximate the terminating end of the flared end portion 132.

Preferably, the only contact between the heat shield 112 and the support structure 110 of the injector 100, i.e. injector support 110, occurs external to the high-temperature, high-pressure compressor air location of the engine case and preferably external to the engine case 103 altogether. This arrangement removes the contact/junction between the heat shield 112 and injector support 110 from direct contact with the compressor air and reduces heat transfer between the heat shield 112 and the injector support 110 by way of conduction through metal. As such and as will be more fully detailed below, the heat shield 112 is, therefore, operably coupled to the injector support 110 to reduce heat transfer therebetween. In this arrangement, there are not any direct local attachments/connections (i.e. such as brazing, welding, etc) between the heat shield 112 and the injector support 110. At most there may be local contacts between the heat shield 112 and the injector support 110, but no local attachments/connections such as by way of brazing, welding, etc. that promote heat transfer therebetween. As used herein a contact may refer only to a line contact, a point contact or a surface contact where two components are pressed into one another, but not bonded.

In a preferred embodiment, the surface of the contact ring 142 that contacts stem mounting flange 124 is rough or otherwise textured so as to provide only point contacts or live contacts therebetween to further reduce heat transfer therebetween by increasing thermal barriers.

To maintain the position of the heat shield 112 relative to injector support 110, the contact ring 142 interacts with the stem mounting flange 124. Typically, the contact ring 142 will be biased or pressed into contact with the stem mounting flange 124.

When assembled in an aperture through the engine case 103, the contact ring 142 is sandwiched between the engine case 103 and the stem mounting flange 124. Bolts, not shown, may be used to press the stem mounting flange 124 into engine case 103. Typically, the contact ring 142 has a wall thickness that is greater than the wall thickness of the flared end portion 132 so as to form a gap between the flared end portion 132 and mounting flange 124.

Additionally, a seal 146 may be included between stem mounting flange 124 and engine case 103 to prevent pressure leakage. Seal 146 may be in the form of an independent seal structure such as the illustrated sealing ring. Preferably, the seal 146 has an arcuate profile so that the interaction between the engine case 103 and the mounting flange 124 is reduced to a line contact to improve sealing performance. When the fuel injector 100 is mounted to the engine case 103, the seal 146 is preferably crushed at least slightly to improve the seal formed between the mounting flange 124 and engine case 103 forming the seal.

In alternative arrangements, albeit less desirable, the contact ring 142 could be removed and the flared end portion 132 could be directly sandwiched between mounting flange 124 and engine case 103.

However, in any of these arrangements, the only path for heat transfer between flared end portion 132 or contact ring 142 and the injector support 110, is external to the high-temperature, high-pressure compressor air 104, and is preferably external to the engine case 103 altogether. Further, the only path for heat transfer between the heat shield 112 and injector support 110 is provided through a contact between the heat shield 112 and the injector support 110, rather than through an integral connection such as a weld, braze, etc. (e.g. a connection with reduced thermal barriers as compared to a mere contact). This arrangement increases the number of thermal barriers reducing the heat transfer between the two components. As used here in "a contact" shall refer to a point contact, line contact or surface contact that is merely two components pressed together but not integrally secured such as by welding or brazing.

A gap 136 is formed between the heat shield body portion 130 and the stem body portion 120. Gap 136 provides a thermal barrier and, depending on the embodiment, may be filled with stagnant air or may be closed and formed by a vacuum to further reduce heat transfer between the heat shield body portion 130 and the stem body portion 120 such as by way of convection or conduction.

While the gap 136 is formed between the heat shield body portion 130 and the stem body portion 120, the heat shield is closely sized to the injector support 110 such that it is secured thereto even when the injector 100 is removed from the engine case 103. More particularly, as described above, the heat shield 112 is secured between the projections of the injector support 110 located at opposite ends thereof, i.e. the mounting flange 124 proximate the upstream end of the injector support and the tip end 137 or injector atomizer 114 located at the downstream end of the injector support 110.

It is also a feature of embodiments of the present invention that shoulder 134 acts a flexure point for the heat shield 112. By acting as a flexure point, the shoulder 134 can provide flexibility to the heat shield 112 so that the heat shield 112 can accommodate thermal expansion and contraction. More particularly, as the heat shield 112 thermally expands, the shoulder 134 will flex axially toward stem mounting flange 124. However, it will then flex away from stem mounting flange 124 when it thermally contracts.

In one embodiment, the shoulder 134 is configured such that it will buckle between convex to concave states due to the thermal expansion and contraction. In some embodiments, this will actually result in the shoulder 134 transition between states of positive and negative stiffness much like the bottom of an oil can.

This added flexure point can act to reduce internal stresses in the fuel injector 100 and absorb some of the excess thermal expansion experienced by the heat shield 112. Thus, in a cooled state, the shoulder 134 has a convex state, i.e. where the terminating end of the flared end portion 132 is closer to the mounting flange 124 than shoulder 134. Then after sufficient thermal expansion of the heat shield 112, and particularly heat shield body portion 130, the shoulder 134 will buckle or bend such that the shoulder 134 is concave, i.e. where the shoulder 134 is closer to the mounting flange 124 than the terminating end of the flared end portion 132.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A fuel injector for comprising:

an injector support including a mounting portion, a stem portion and a mounting flange interposed between the mounting portion and the stem portion and extending radially outward from the head and stem portions, the injector support further including a bore extending through the mounting portion and stem portion; and a heat shield surrounding at least the stem portion of the injector support, wherein the heat shield is operably coupled to the injector support to reduce heat transfer therebetween;

wherein the heat shield is operably coupled to the injector support such that the heat shield interacts with the injector support solely through one or more contacts; and wherein the heat shield includes a generally annular body portion extending between first and second opposed ends, the heat shield further including a radially outward extending flared extension portion proximate a first end thereof, the first end of the heat shield contacting the mounting flange proximate a terminating end of the flared extension portion.

2. The fuel injector of claim 1, wherein a gap is formed between the heat shield and the injector body.

3. The fuel injector of claim 2, wherein the flared extension portion further includes a contact ring, the contact ring having a wall thickness greater than the wall thickness of the heat shield, the contact ring forming the part of the flared extension portion proximate the terminating end being in contact with the mounting flange.

4. The fuel injector of claim 1, wherein the heat shield includes a transition shoulder transitioning the body portion into the flared extension portion.

5. The fuel injector of claim 4, wherein the transition shoulder provides a flexure point for accommodating thermal expansion and contraction of the heat shield by transitioning between a concave state and a convex state.

6. The fuel injector of claim 4, wherein the mounting flange and flared extension portion extend at an angle of between about fifty degrees and ninety degrees relative to an axis defined by the stem portion.

7. The fuel injector of claim 6, wherein the mounting flange and the flared extension portion are substantially parallel to one another.

8. The fuel injector of claim 1, wherein the injector support further includes a protrusion proximate a downstream end, the heat shield is axially secured to the injector support by being positioned between the mounting flange and the protrusion

9. A combustion assembly for combusting fuel, comprising:

an engine case defining a cavity;

a fuel injector mounted to the engine case, the fuel injector including a support structure including a mounting portion, a body portion and a mounting flange extending radially outward from the mounting portion;

a heat shield including a heat shield body portion and a flared flange, the flared flange extending radially outward beyond the heat shield body portion; and wherein the fuel injector extends into the cavity through an aperture in the engine case with the mounting portion positioned outside of the cavity and the body portion positioned within the cavity, the aperture being sized smaller than the mounting flange and the flared flange such that the mounting flange and flared flange overlap a portion of the engine case, the overlapping portion of the flared flange being sandwiched between the engine case and the mounting flange.

10. The combustion assembly of claim 9, wherein the flared flange includes a contact ring, the contact ring forming a terminating end of the flared flange.

11. The combustion assembly of claim 9, wherein the flared flange only contacts the mounting flange at a location external to the cavity.

12. The combustion assembly of claim 11, wherein the heat shield is operably coupled to the support structure to reduce heat transfer therebetween.

13. The combustion assembly of claim 12, wherein the heat shield interacts with the support structure solely through contacts.

14. The combustion assembly of claim 13, wherein the surface of the flared flange that contacts the mounting flange is textured to reduce heat transfer between the flared flange and the mounting flange.

15. The combustion assembly of claim 10, wherein the contact ring has a wall thickness that is greater than a wall thickness of the rest of the flared flange such that a gap is formed between the rest of the flared flange and the mounting flange when the contact ring is in contact with the mounting flange.

16. A fuel injector for use in a combustion chamber bounded by a boundary, the boundary wall defining an aperture through which the injector can extend, the fuel injector comprising:

an injector support including a stem portion and a mounting flange extending radially outward from the stem portion, the injector support further including a bore extending through stem portion; and a heat shield including a body portion, a flared end extending radially outward from the body portion and a shoulder transitioning between the body portion and the flared end, the body portion surrounding the stem portion of the injector support, the flared end being generally aligned with the mounting flange of the injector support, the shoulder and the mounting flange forming a gap therebetween, wherein the shoulder provides a flexure point for accommodating thermal expansion and contraction of the heat shield by transitioning between a concave state and a convex state.

17. The fuel injector of claim 16, wherein the heat shield is operably coupled to the injector support solely through contacts.

18. The fuel injector of claim 16, wherein the shoulder flexes in a direction extending generally perpendicular to the radially extending flared end.

* * * * *